US008170172B2

(12) United States Patent
Uhland

(10) Patent No.: US 8,170,172 B2
(45) Date of Patent: May 1, 2012

(54) TARGET BODIES AND USES THEREOF IN THE PRODUCTION OF RADIOISOTOPE MATERIALS

(75) Inventor: William Claude Uhland, St. Charles, MO (US)

(73) Assignee: Mallinckrodt LLC, Hazelwood, MO (US)

( * ) Notice: Subject to any disclaimer, the term of this patent is extended or adjusted under 35 U.S.C. 154(b) by 195 days.

(21) Appl. No.: 12/518,645

(22) PCT Filed: Dec. 11, 2007

(86) PCT No.: PCT/US2007/025431

§ 371 (c)(1),
(2), (4) Date: Jun. 11, 2009

(87) PCT Pub. No.: WO2008/073468

PCT Pub. Date: Jun. 19, 2008

(65) Prior Publication Data

US 2010/0046689 A1 Feb. 25, 2010

Related U.S. Application Data

(60) Provisional application No. 60/874,437, filed on Dec. 11, 2006.

(51) Int. Cl.
*G21G 1/00* (2006.01)

(52) U.S. Cl. ..... 376/156; 376/202

(58) Field of Classification Search ..... 376/156, 376/202

See application file for complete search history.

(56) References Cited

U.S. PATENT DOCUMENTS

| | | | | |
|---|---|---|---|---|
| 2,504,585 | A | 4/1950 | Reid | |
| 3,646,348 | A | 2/1972 | Detaint | |
| 3,924,137 | A * | 12/1975 | Alger | 376/151 |
| 4,555,275 | A * | 11/1985 | Tobin | 148/277 |
| 5,420,073 | A * | 5/1995 | DiGiacomo et al. | 216/14 |

FOREIGN PATENT DOCUMENTS

| | | |
|---|---|---|
| EP | 0 003 819 | 9/1979 |
| WO | WO 97/07122 | 2/1997 |

* cited by examiner

*Primary Examiner* — Ricardo Palabrica

(57) ABSTRACT

A system and method are provided for reclaiming an enriched radioisotope starting material (14) from a target body (12). The system and method enable reclaiming the starting material in a relatively short time (e.g., several hours) after the target body's bombardment with energetic particles, greatly simplifying the target body's chemical processing, as well as reducing the cost of such processing (e.g., reducing the need for costly long-term storage). Specifically, a chemical protective layer (16) is disposed between a radioisotope starting material (14) and a base material (18) of the target body (12). After the target body is irradiated with a suitable source (e.g., particle accelerator), then the irradiated radioisotope starting material and be removed without removing the base material due to the protection provided by the chemical protective layer. The system and method also enable the operator to obtain three different radioisotopes in a single bombardment of the target body, further reducing cost of radioisotope production.

12 Claims, 10 Drawing Sheets

TARGET BODIES AND USES THEREOF IN THE PRODUCTION OF RADIOISOTOPE MATERIALS

CROSS REFERENCE TO RELATED APPLICATIONS

This application is a national stage application of PCT/US2007/025431, filed Dec. 11, 2007, which claims the benefit of U.S. Provisional Application No. 60/874,437 filed Dec. 11, 2006.

FIELD OF THE INVENTION

The present invention relates generally to radioisotope materials and, more specifically, to a system and method for efficiently producing radioisotope materials.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Production of radioisotopes can be achieved by accelerating charged or uncharged particles, via a particle accelerator, onto a target containing an enriched radioisotope starting material. Typically, such material includes high proportions of a nonradioactive material, which may at least partially transmute into radioactive material when the nonradioactive material is irradiated with energetic particles (e.g., protons or neutrons). While colliding with the target having the nonradioactive starting material deposited thereon, the charged particles (e.g., protons) interact with nuclei of the enriched radioisotope starting material to induce nuclear reactions within the radioisotope starting material, thereby producing the desired radioisotope. Unfortunately, during bombardment of the target, accelerated protons may also interact with the target's base material disposed adjacent to the starting material, thereby producing radioisotopes that may exhibit a relatively long decay time or half-life, which is the amount of time it takes a radioactive material to decay half its initial amount. As a result, the long half-life radioisotopes of the base material tend to prevent immediate reclamation of the nonradioactive portion of the starting material. Consequently, a substantial period of time, in some cases up to six months or more, may elapse before the level of radiation decreases to a safe level, permitting reclamation of the source nonradioactive portion of the starting material. During this time, the highly radioactive materials are generally stored in special areas, which may significantly increase the cost of producing radioisotopes.

SUMMARY

Certain exemplary aspects of the invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

A system and method are provided for reclaiming an enriched radioisotope starting material from a target body bombarded with energetic charged particles. The system and method enable an operator to reclaim the starting material in a relatively short time (e.g., several hours) after the target body's bombardment, greatly simplifying the target body's chemical processing, as well as reducing the cost of such processing (e.g., reducing the need for costly long-term storage). Specifically, in some embodiments, a chemical protective layer is disposed between a radioisotope starting material and a base material of the target body. After the target body is irradiated with a suitable source (e.g., particle accelerator), then the irradiated radioisotope starting material can be removed without removing the base material due to the protection provided by the chemical protective layer. For example, the chemical protective layer may be chemically resistant to a chemical used to remove the irradiated radioisotope starting material. The system and method may enable the operator to obtain three different radioisotopes in a single bombardment of the target body, further reducing cost of radioisotope production. For example, the irradiated radioisotope starting material may be removed via a first chemical that generally does not react with the chemical protective layer, the chemical protective layer may be subsequently removed via a second chemical that generally does not react with the base material, and then the base material may be subsequently removed via a third chemical.

A first aspect of the invention is directed to a target body having a radioisotope starting material (e.g., thallium 203) that, when bombarded with energetic particles, yields radioisotopes from which radiopharmaceuticals may be derived. The radioisotope starting material is disposed over a chemical protective layer (e.g., chromium having a rough or matte finish), which in turn, is disposed over a base layer (e.g., copper or aluminum) of the target body. The target body may be coupled (e.g., connected directly or indirectly) to a coolant system (e.g., a circulating fluid coolant such as water) adapted to remove heat from the target body while it is irradiated with energetic particles.

A second aspect of the invention is directed to a target body for use in the production of radioisotopes. This target body includes a base, a protective layer disposed on the base, and a radioisotope starting material disposed on the protective layer. The base, the protective layer, and the starting material are oriented such that the protective layer is disposed between the base and the radioisotope starting material. Further, the base of this target body includes a coolant path.

Yet a third aspect of the invention is directed to a method for producing a target body having a protective layer disposed thereon. The protective layer (e.g., a layer of chromium) may be electroplated onto the base layer of the target body. Electroplating of the chromium onto a base layer of the target body may be performed so that the chromium attains a surface which has a rough texture. In other words, the surface may appear dull and feel relatively rough, rather than a shiny appearance and smooth feel. The rough texture of the chromium's surface provides a surface morphology suitable for retaining a radioisotope starting material. For example, the surface morphology may be achieved by a relatively prolonged electroplating process (e.g., 30 minutes rather than 5 minutes).

Still a fourth aspect of the invention is directed to a method for producing a target body for use in the production of a radioisotope. In this method, a protective layer (e.g., a layer of chromium) is electroplated onto a base of the target body. Thereafter, a radioisotope starting material (e.g., thallium 203) is deposited onto the protective layer such that the protective layer is located between the base and the radioisotope starting material.

Yet a fifth aspect of the invention is directed to a method for removing a material from an irradiated target body. In this aspect, a first layer containing a first radioisotope material is chemically stripped from the irradiated target body. Removal of a second layer of the target body is substantially hindered or prevented using a third layer of the target body. This third layer of the target body is located between the first layer and the second layer prior to the first layer being chemically stripped from the irradiated target body.

Still yet a sixth aspect of the invention is directed to a method of producing a radioisotope. In this method, energetic particles are bombarded onto a starting material that is deposited on a chemical protective layer of a target body to generate a radioisotope of the starting material.

In yet a seventh aspect, the invention is directed to a system for producing radioisotopes. This system includes a particle accelerator, a target body, and a control system coupled to the particle accelerator. The target body of this seventh aspect includes a base, a protective layer disposed on a surface of the base, and a radioisotope starting material disposed on the protective layer. This protective layer is located between the base and the radioisotope starting material. Further, the protective layer includes chromium, tantalum, tungsten, gold, niobium, aluminum, zirconium, or platinum, or a combination thereof.

Various refinements exist of the features noted above in relation to the various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

BRIEF DESCRIPTION OF THE FIGURES

Various features, aspects, and advantages of the present invention will become better understood when the following detailed description is read with reference to the accompanying figures in which like characters represent like parts throughout the figures, wherein.

DETAILED DESCRIPTION OF THE SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a", "an", "the", and "said" are intended to mean that there are one or more of the elements. The terms "comprising", "including", and "having" are intended to be inclusive and mean that there may be additional elements other than the listed elements. Moreover, the use of "top", "bottom", "above", "below" and variations of these terms is made for convenience, but does not require any particular orientation of the components. As used herein, the term "coupled" refers to the condition of being directly or indirectly connected or in contact.

Figure 1:
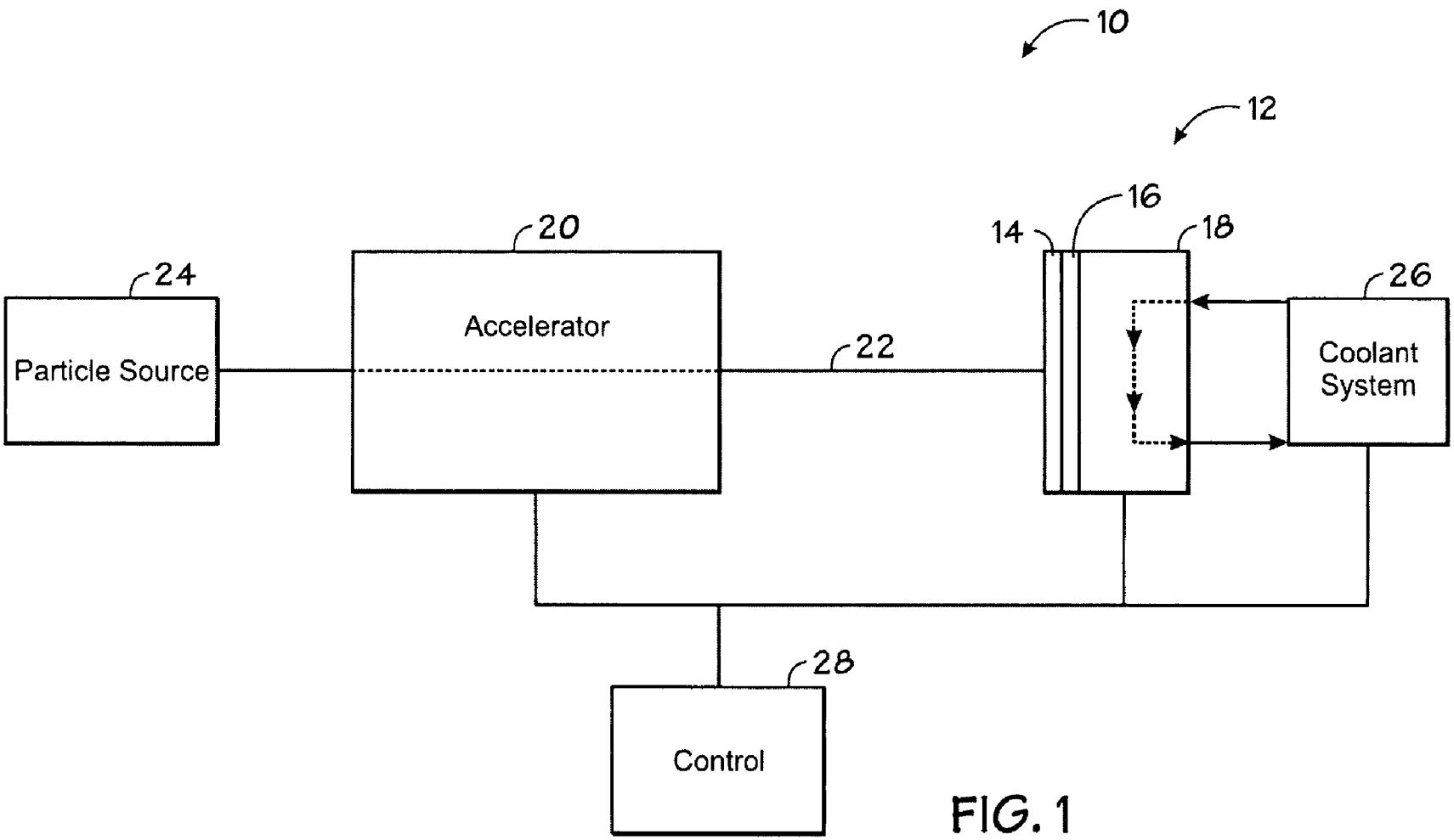
FIG. 1 is a block diagram of a particle accelerating system.

Turning now to the figures, FIG. 1 is a block diagram of an exemplary particle accelerating system 10. The system 10 includes a target body 12 having multiple layers, at least one of which is adapted for producing a radioisotope when that layer is irradiated with energetic charged particles. The target body 12 may include a layer 14, including an enriched radioisotope starting material, which may produce a radioisotope when bombarded or irradiated with the energetic charged particles. In turn, the radioisotope may be used alone or in combination with other substances (e.g., tagging agents) as a radiopharmaceutical for medical diagnostic or therapeutic purposes. The layer 14 may include a radioisotope starting material, such as cadmium-112, or zinc-68, or thallium 203, or a combination thereof. For instance, in some embodiments, the layer 14 may include enriched thallium 203 from which radiopharmaceutical thallium 201 can be obtained and used in nuclear medicine.

The starting material that makes up the layer 14 may be disposed on a protective layer 16 having a matte-finish or rough surface configured to retain the starting material on the target body 12. In other words, the surface of the protective layer 16 may appear dull and feel rough. The protective layer 16 is a chemical protection layer adapted to chemically shield base layer 18 while the target body 12 is chemically processed to obtain desired radiopharmaceuticals produced from irradiation of the target body 12. The protective layer 16 may include chromium and/or other materials, such as iridium, tantalum, tungsten, gold, niobium, aluminum, zirconium, or platinum, or a combination thereof, that are inert to a chemical substance used when the layer 14 is chemically stripped-off the target body 12 after bombardment. That is, the layer 16 may generally prevent unwanted radioisotope byproducts having a long half-life contained within the base layer 18 from dissolving within the chemical stripping solution, such as nitric acid, which may contain radioisotopes produced from the layer 14. In this manner, the protective layer 16 may ensure that only the desired radioisotopes are obtained via the chemical stripping procedure, such that the starting material may be reclaimed with ease in a relatively short amount of time.

The protective layer 16 may be deposited onto the base layer 18 via electroplating or other methods enabling formation of the layer 16 onto the base layer 18 without the use of any adhesive or intermediate layer. For example, the target body 12 may be electroplated for a relatively long duration of time (e.g., 15, 20, 25, 30, 45, 50, or more minutes) to increase the amount and roughness of the protective layer 16 on the base layer 18. It has been found that a suitable rough layer 16 of chromium may be achieved by electroplating the base layer 18 for about 25-30 minutes, which is significantly greater than conventional electroplating of chromium (e.g., several minutes or less). It should be noted that the results (e.g., relatively thick, rough layer 16) of this prolonged electroplating of chromium is undesirable for other applications, which generally desire a smooth shiny layer of chromium. That being said, a unique result of the prolonged electroplating is an improved ability to adhere other materials onto the electroplated layer 16.

The base layer 18 of the target body 12 may include a metal, such as copper, aluminum and/or other conductive material(s). For example, the base layer 18 may be molded out of aluminum and then coated with copper. Being conductive, the base layer 18 of the target body 12 may be adapted to transfer heat efficiently away from the target body 12 as temperature increases while the target body 12 is irradiated.

The particle accelerating system 10 includes a particle accelerator 20 configured to accelerate charged particles, as shown by line 22. The charged particles 22 accelerate to attain enough energy to produce radioisotope material once the particles 22 collide with the target body 12. Thus, the layer 14 may include a mixture of radioisotope and radioisotope starting material. Production of the radioisotope is facilitated through a nuclear reaction occurring once the accelerated particles 22 interact with the starting material of the layer 14. For example, when producing radioisotope thallium 201, enriched thallium 203 may be irradiated with protons 22 accelerated via the accelerator 20. The protons 22 may originate from a particle source 24 that injects the charged particles 22 into the accelerator 20 so that the particles 22 may be accelerated towards the target body 12.

As the accelerated charged particles 22 collide with the target body 12, a substantial amount of the particles' kinetic energy may be absorbed by the target body 12. Absorption of the energy imparted by the accelerated particles 22 may cause the target body 12 to heat up. To mitigate overheating of the target body 12, the target body 12 may be coupled to a coolant system 26 disposed adjacent to the target body 12. The coolant system 26 may include fluid connectors that are fluidly coupled to the target body 12 so that fluid, such as water, may circulate along or through the target body 12, thereby removing heat absorbed by the target body 12 during irradiation of the same. In the illustrated embodiment, the coolant system 26 is shown as being separate from the target body 12 and disposed behind the target body 12. In other embodiments, the cooling system 26 may be part of the target body 12, or it may be disposed remote from the target body 12.

The particle accelerating system 10 includes a control system 28 coupled to the particle accelerator 20, the target body 12, and/or the coolant system 26. The control system 28 may be configured to, for example, control parameters, such as accelerating energy of the particles 22, current magnitudes of the accelerated charged particles 22, and other operational parameters relating to the operation and functionality of the accelerator 20. The control system 28 may be coupled to the target body 12 to monitor, for example, the temperature of the target body 12. The control system 28 may be coupled to the coolant system 26 to control temperature of the coolant and/or monitor and/or control flow rate.

Figure 2:
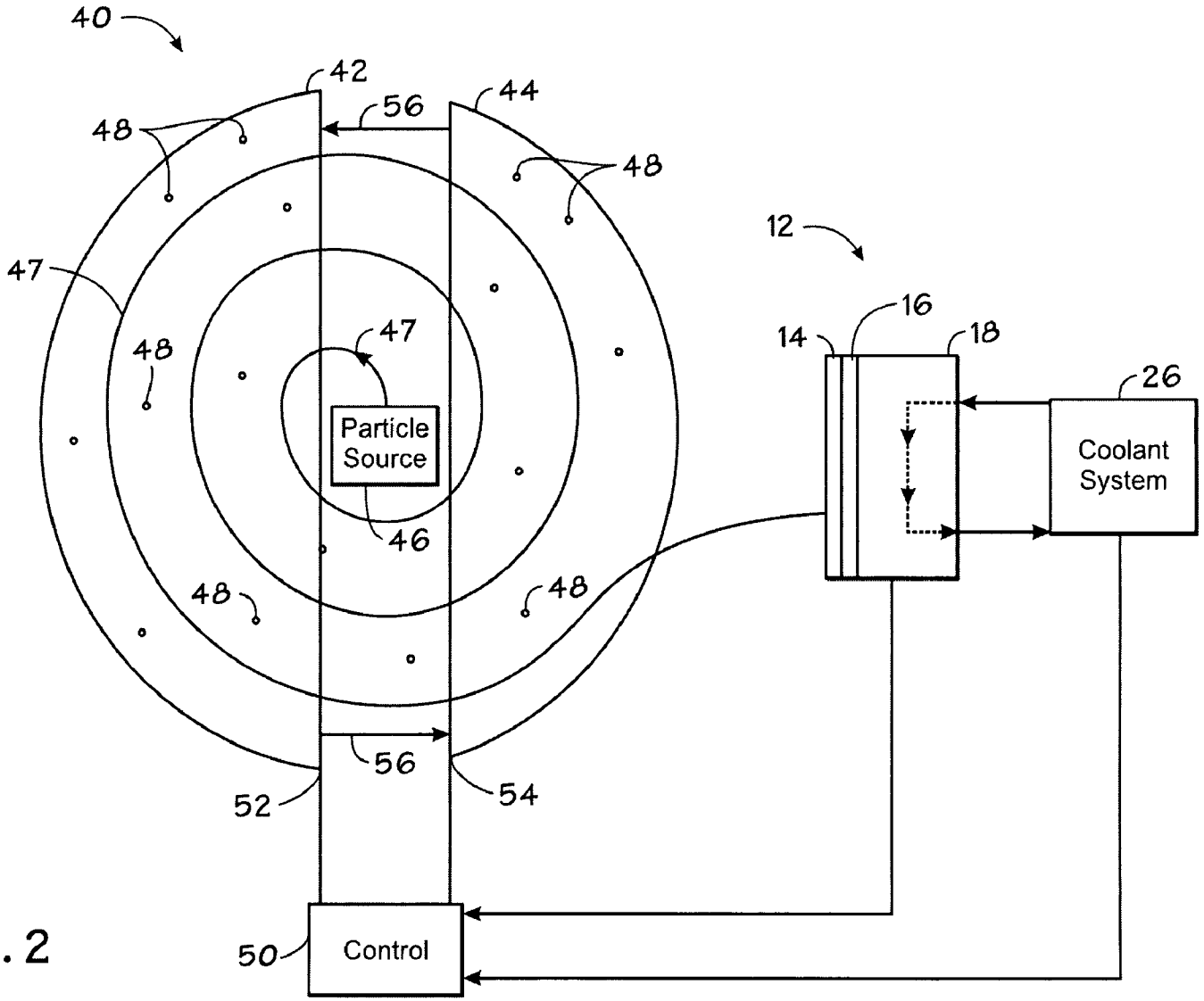
FIG. 2 is a diagram of a cyclotron.

Referring now to FIG. 2, another particle accelerator 40 is illustrated for use with the target body 12 having the protective layer 16. The particle accelerator 40 may include a cyclotron used for accelerating charged particles, such as protons. The cyclotron 40 may employ a stationery magnetic field and an alternating electric field for accelerating charged particles. The cyclotron 40 may include two D-shaped hollow vacuum chambers 42, 44 separated by a certain distance. Disposed between the chambers 42, 44 is a particle source 46. The particle source 46 emits charged particles 47 such that the particles' 47 trajectories begin at a central region disposed between the hollow D-shaped vacuum chambers 42, 44. A magnetic field 48 of constant direction and magnitude is generated throughout the chambers 42, 44 such that the magnetic field 48 may point inward or outward perpendicular to the plane of the chambers 42, 44. Dots 48 depicted throughout the vacuum chambers 42, 44 represent the magnetic field pointing inwardly or outwardly from the plane of chambers 42, 44. In other words, the D-shaped surfaces of the hollow vacuum chambers 42, 44 are disposed perpendicular to the direction of the magnetic field.

Each of the hollow vacuum chambers 42, 44 may be connected to a control 50 via connection points 52, 54, respectively. The control 50 may regulate an alternating voltage supply, for example contained within the control 50. The alternating voltage supply may be configured to create an alternating electric field in the region between the chambers 42, 44, as denoted by arrows 56. Accordingly, the frequency of the voltage signal provided by the voltage supply creates an oscillating electric field between the chambers 42, 44. As the charged particles 47 are emitted from the particle source 46, the particles 47 may become influenced by the electric field 56, forcing the particle 47 to move in a particular direction, i.e., in a direction along or against the electric field, depending on whether the charge is positive or negative. As the charged particles 47 move about the chambers 42, 44, the particles 47 may no longer be under the influence of the electric field. However, the particles 47 become may become influenced by the magnetic field pointing in a direction perpendicular to their velocity. At this point, the moving particles 47 may experience a Lorentz force causing the particles 47 to undergo uniform circular motion, as noted by the circular paths 47 of FIG. 2. Accordingly, every time the charged particles 47 pass the region between the chambers 42, 44, the particles 47 experience an electric force caused by the alternating electric field, which increases the energy of the particles 47. In this manner, repeated reversal of the electric field between the chambers 42, 44 in the region between the chambers 42, 44 during the brief period the particles 47 traverse therethrough causes the particles 47 to spiral outward towards the edges of the D-shaped chambers 42, 44.

Eventually, the particles 47 may reach a critical radius such that their velocity may be too great for the particles 47 to sustain a circular path, causing them to shoot-off tangentially into the target body 12. Energy gained while the particles 47 accelerate may be deposited into the target body 12 when the particles 47 collide with the target body 12. Consequently, this may initiate nuclear reactions within the target body 12, producing radioisotopes within the layers 14-18 of the target body 12. The control 50 may be adapted to control the magnitude of the magnetic field 48 and the magnitude of the electric field 56, thereby controlling the velocity and, hence, the energy of the charged particles as they collide with the target body 12. The control 50 may also be coupled to the target 14 and/or the coolant system 26 to control parameters of the target 14 and/or the coolant system 26 as described above with respect to FIG. 1.

Figure 3:
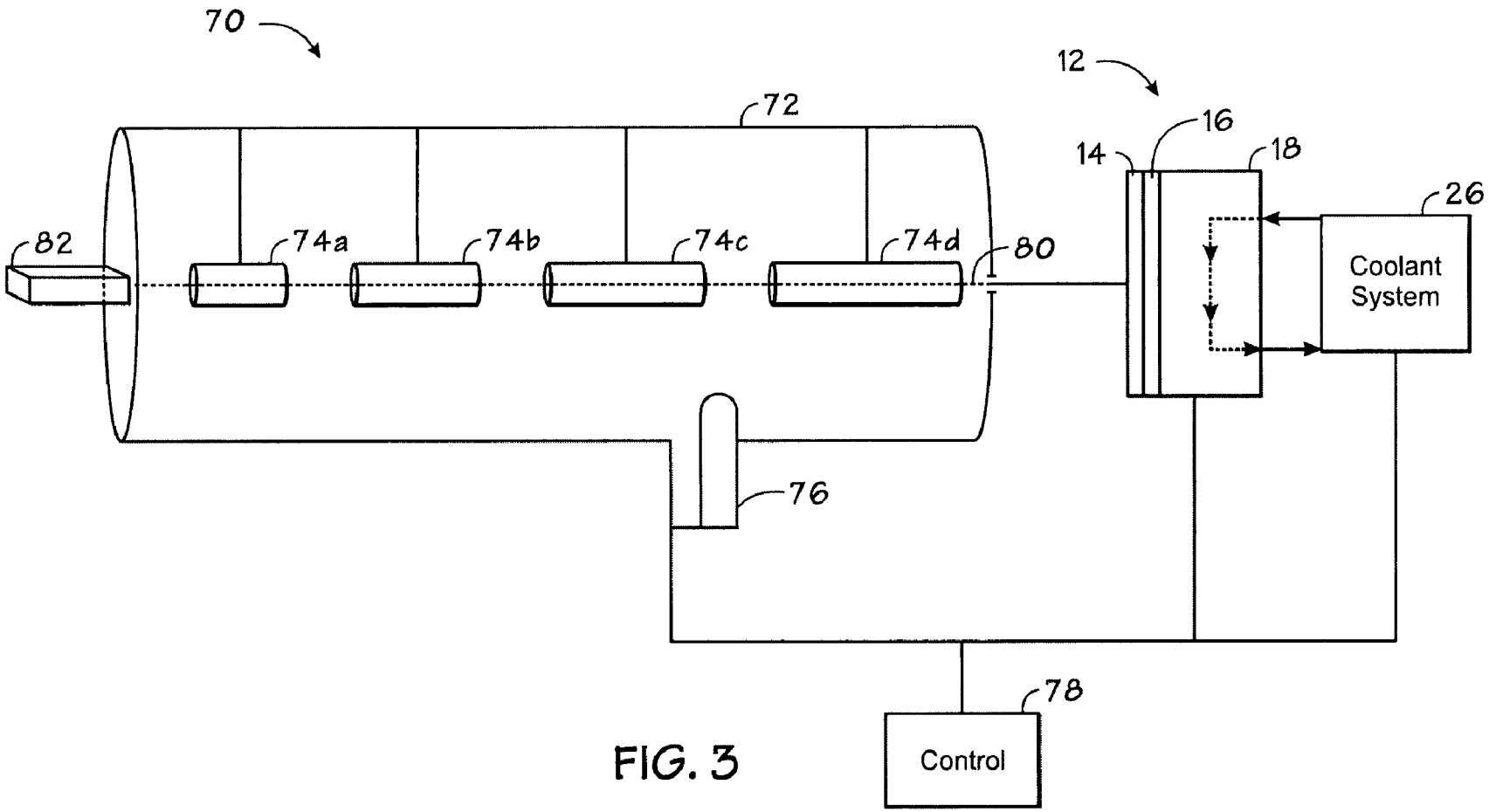
FIG. 3 is a diagram of a linear particle accelerator.

FIG. 3 illustrates a linear particle accelerator 70 for use with the target body 12 having the protective layer 16. The linear accelerator 70 may include a long hollow tube formed of a conducting material such as copper or aluminum. Disposed within the tube 72 are small hollow tubes 74*a*-74*d*, formed of a conducting material. The hollow tube 72 of the linear accelerator 70 may be coupled to a radio frequency (RF) generator 76 having an electrode configured to emit a RF signal of particular frequencies to propagate within the tube 72. The RF generator 76 is further coupled to control 78 adapted to control operational parameters, such as RF frequencies and other functionalities of the linear accelerator 70.

Electromagnetic waves generated by the RF generator 76 propagate within the hollow tube 72 causing charged particles 80 originating from the particle source 82 to accelerate when the particles 80 are subjected to an electric field propagating down the tube 72. This electric field accelerates the particles 80 further down the tubes 72 as the particles 80 gain kinetic energy. The charged particles 80 are also guided through hollow tubes 74*a*-74*d*, such as those shown by FIG. 3, to ensure a linear path of the particles 80. As depicted by FIG. 3, the lengths of the hollow tubes 74*a*-74*d* increase down the length of the hollow tube 72 as the velocity of the particles 80 increases. In this manner, the charged particles 80 may be optimally accelerated in accordance with the RF frequency produced by the RF generator 76.

Control 78 may be connected to the hollow tube 72, the RF generator 76, the target body 12, and/or the coolant system 26. The control 78 may control the frequency of the RF generator 76, thereby controlling the acceleration of the charged particles 80 as the charged particles 80 propagate along the hollow tube 74*a*-74*d*. Control 78 may be coupled to the target body 12 to monitor parameters, such as temperature, and other related feedback pertaining to the accelerator 70 and the target body 12.

Figure 4:
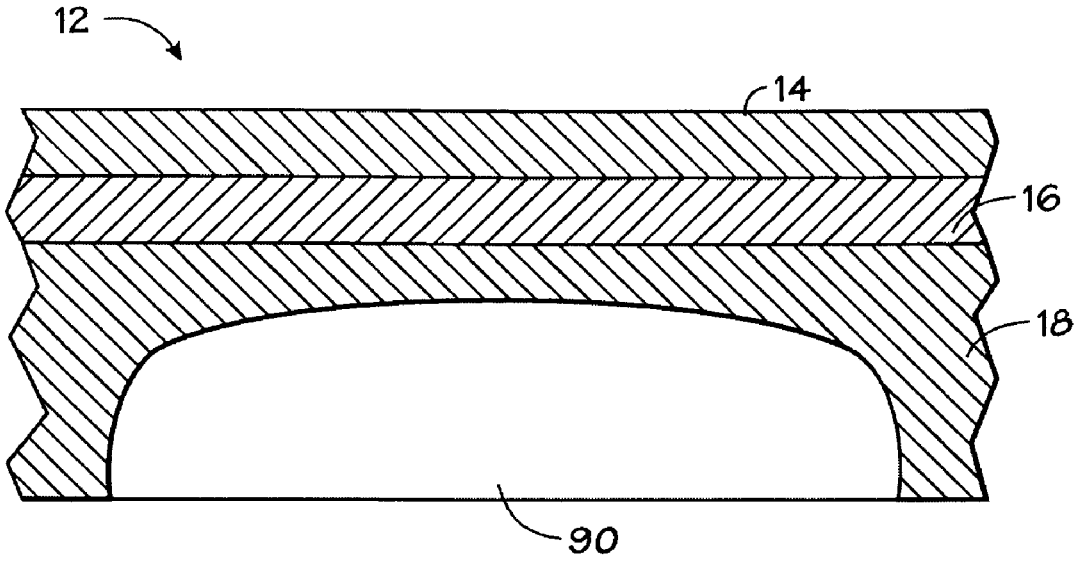
FIG. 4 is a cut-away, cross-sectional view of a target body.

FIG. 4 is a partial cross-sectional view of an embodiment of the target body 12. The target body 12 may include a starting material 14, such as enriched thallium 203, cadmium-112, zinc-68 or other types of source materials, disposed on a chromium layer 16. The protective chromium layer 16 is disposed on a target base layer 18. The chromium layer 16 can be disposed on the base layer 18 via an electroplating process. Again, the electroplating process may be prolonged relative to conventional electroplating of chromium (e.g., 30 minutes rather than several minutes or less), such that a desired thickness is achieved to protect the base layer 18 and a desired roughness is achieved to secure the starting material 14 to the chromium layer 16. Other materials such as tantalum, tungsten, gold, niobium, aluminum, zirconium, or platinum, or a combination thereof, may be disposed on the base layer 18 via the electroplating process.

Electroplating the chromium layer 16 onto the base layer 18 may involve certain steps for ensuring that the chromium layer 16 has attributes suitable to support the starting material 14 and produce a radioisotope. Such attributes may include chromium layer thickness and surface texture. The process of electroplating chromium onto the target body 12 may include buffing and/or polishing portions of the target body 12 designated for chromium electroplating. Portions of the target body 12 not designated for chromium electroplating may be coated with certain protective coats that may prevent the electroplating of the chromium to those portions of the target body 12. Thereafter, the target body 12 may be immersed in a tank or vessel containing a solution of chromium and other associated materials contributing to the electroplating process. The target body 12 may be immersed in the tank until a desired chromium thickness is electroplated onto the target base layer 18. In some embodiments, the target body 12 may be electroplated for an amount of time extending between 25-45 minutes. During the electroplating process the electroplating tank may be maintained at approximately 125 degrees.

After a desired thickness of chromium is electroplated onto the base layer 18, the target body 12 may be removed from the chromium tank and inspected to verify that the thickness and other attributes of the chromium layer are suitable to support the starting material 14. For example, the difference in weight of the target body 12 before and after the electroplating process may be measured and a chromium thickness may be obtained. Further, as previously mentioned, it may be desirable to obtain a chromium layer with a rough surface morphology adapted to retain the radioisotope source material while the target body 12 is irradiated. That is, the surface of the chromium layer 16 may have roughness and granularity suitable for maintaining, for example, thallium 203 onto the target body 12 during its bombardment by charged particles. Thus, after the target body 12 is electroplated, the chromium disposed thereon is not polished in any manner so that the surface of the chromium layer 16 retains its roughness. Such surface roughness characteristics of the chromium layer 16 may be inspected via an electron microscope and/or via its ability to retain water for certain periods of time.

The base layer 18 of the target body 12 may include or be substantially consist of a metallic material such as copper, aluminum, or other conductive materials or combinations thereof. In some embodiments, the base layer 18 may be an aluminum structure coated with copper. As further depicted by FIG. 4, a coolant passage 90 may be formed as part of a channel or groove lengthwise along the target body 12. The coolant channel 90 facilitates fluid flow along the target body 12 so that heat may be removed from the target body 12 while the target body 12 is irradiated with charged particles.

During bombardment of the target body 12, nuclear interactions between the colliding charged particles and atomic nuclei of materials of the target body 12 may transform a portion of those nuclei into radioisotopes. For example, after bombardment, the layer 14 may include a combination of enriched thallium 203 and radioisotope lead 201. The lead 201 may subsequently decay into thallium 201, which is a desired radioisotope for use in nuclear medicine. Similarly, some atomic nuclei of the chromium layer 16 and the base layer 18 may transform into radioisotope nuclei from which other desired radiopharmaceuticals may be yielded.

Extracting the desired radiopharmaceuticals from the target body 12 may involve chemical processing of the target body 12. The chemical processing of the target body 12 may be adapted to remove certain layers of the target body 12 while keeping others intact. After bombardment, for example, the thallium 203 and the lead 201 may be stripped from the target body 12 using hot nitric acid, which is configured to remove those substances but not the chromium layer 16. That is, the radioisotope starting material, such as thallium 203, may be susceptible to removal by chemicals that may cause the thallium 203 to strip from the target body 12, whereas the chromium layer 16 may be chemically inert or resistant to removal by such stripping chemicals and, therefore, may not strip from the target body 12. Thus, the chromium layer 16 shields the base layer 18 from the nitric acid-stripping, thereby generally preventing or reducing the likelihood of radioisotope metals with a long half-life disposed in the base layer 18 from dissolving into the solution containing the thallium 203 and the lead 201. In this manner, further chemical processing of the solution containing the thallium 203 and the lead 201 may proceed in a relatively short amount of time after bombardment so that the aforementioned substances are separated. The solution containing the thallium 203 and the lead 201 can be processed to further chemically separate the lead 201, leaving behind a solution containing thallium 203, which can be reclaimed and, thus, reused for producing additional thallium 201 for radiopharmaceuticals. In this manner, it may be possible to reclaim the thallium 203 quite quickly (e.g., several hours or days) from the chemical solution, thereby generally avoiding expensive storage (e.g., for several months or even years) of the chemical solution containing the thallium 203 and 201 until radiation levels produced from other radioisotope metals subsides.

After the layer 14 containing the thallium 203 and the lead 201 is removed from the target body 12, the target body 12 may further be chemically processed to remove the chromium layer 16, from which chromium 51 may be derived. The chromium 51 may be used as a radiopharmaceutical, particularly, for tagging red blood cells. The chromium 51 may be removed from the target body 12 using hydrochloric acid, which does not react with metals of the base layer 18 of the target body 12. Using hydrochloric acid may prevent radioisotope metals produced from the base layer 18 (i.e., during bombardment of the target body 12) from dissolving into the solution containing the chromium 51. In this manner, a single bombardment of the target body 12 may yield two radiopharmaceuticals, i.e., thallium 201 from the layer 14 and chromium 51 from the layer 16. Because operational costs of particle accelerators used for bombarding targets to produce radiopharmaceuticals can be relatively high, producing two radioisotopes at the price of one target irradiation may significantly improve cost effectiveness of producing radiopharmaceuticals. As discussed further below, a single irradiation of the target may further produce a third radiopharmaceutical obtainable from radioisotopes produces by the base layer 18 of the target body 12.

Figure 5:
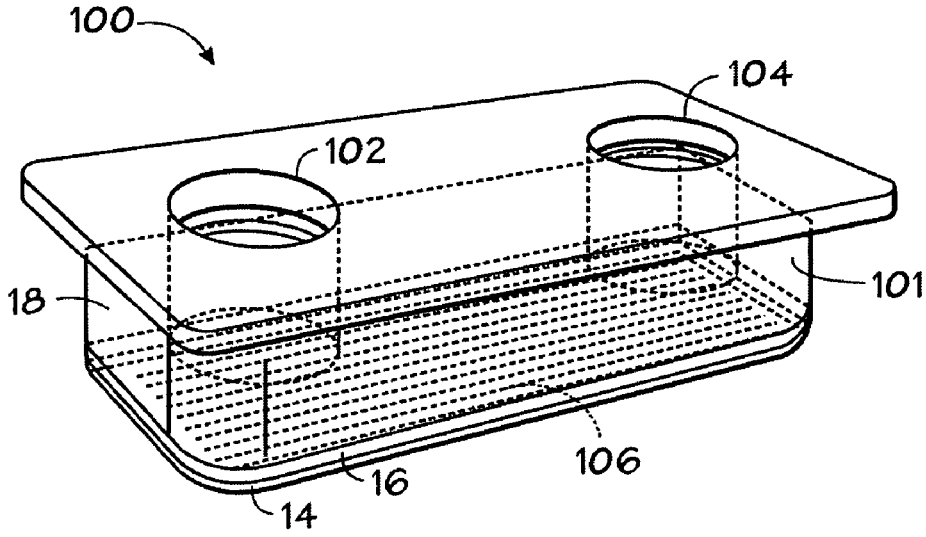
FIGS. 5 and 6 are perspective views of a target body.

FIG. 5 illustrates a perspective view of another target body 100 having the protective layer 16. The target body 100 may be similar to the target body 12 discussed with reference to FIGS. 1-4. Accordingly, the target body 100 includes the layers 14, 16 and 18 similar to those layers discussed with reference to the target body 12. The target body 100 is shown as including a hollow chamber 101 having tubular openings 102, 104. The tubular openings 102 and 104 extend from the back surface of the target body 100 downward into the target's base material 18. The tubular openings 102, 104 may be connected internally within the base layer 18 such that a channel is formed between the two tubular openings 102, 104.

The tubular openings 102, 104 may be coupled to an external cooling source, such as the coolant source 26 shown in FIG. 1, which may be configured to supply a coolant such as water to the target body 100. Using external tubes coupled to the openings 102, 104, the coolant may enter through opening 102 into a channel disposed therebetween and exit the target body 100 via opening 104 back to the coolant source. Grooves 106 disposed on the inner side of the base layer 18 are configured to increase the surface area of the target body 100, thereby improving heat transfer from the target to the coolant as the target body 100 heats while the target it is irradiated.

Figure 6:
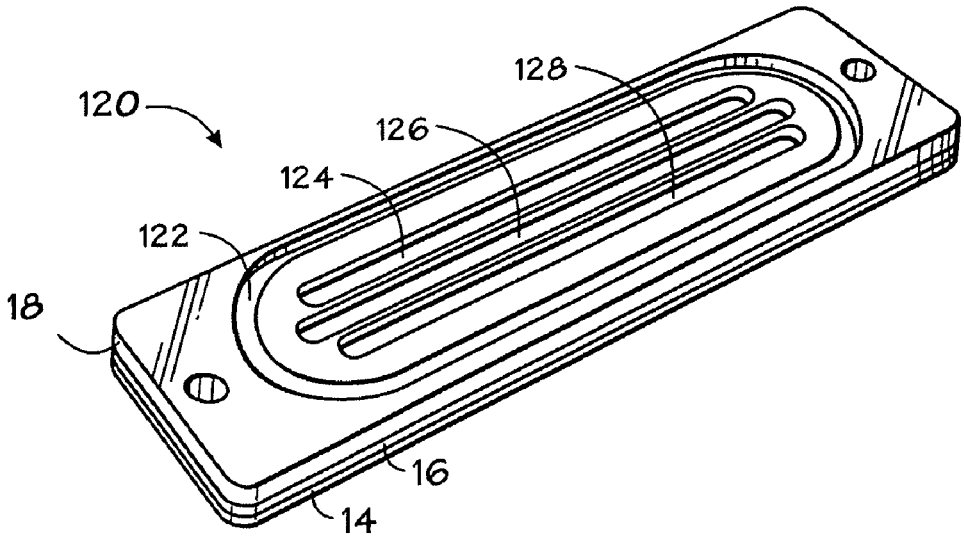

FIG. 6 is a perspective view of another target body 120 having the protective layer 16. The target body 120 is similar to the target body 12 discussed with reference to FIGS. 1-4. Particularly, FIG. 6 depicts a back side perspective view of the target body 120. In the illustrated embodiment, the target body 120 includes the source layer 14 disposed adjacent to the protective layer 16, such as chromium electroplated to the target's base material 18. Further, the target body 120 may include grooves 122-128 forming linear and circular channels on the backside of the target body 120. The grooves 122-128 may extend substantially into the target's base 18, thereby effectively increasing the surface area of the backside of the target body 120. In other embodiments, the grooves 122-128 may form other shapes and geometries and/or may have varying depths. The backside of the target body 120 may be coupleable to a coolant source, such as the coolant source 26 discussed herein with reference to FIG. 1. The coolant source 26 may supply a coolant to the backside of the target body 120 so that coolant may flow through the grooves or channels 122-128, removing excessive heat from the target body 120 as it heats up while the target is irradiated. Moreover, the channel 122 may form a seal with a portion of the coolant source 26.

Figure 7:
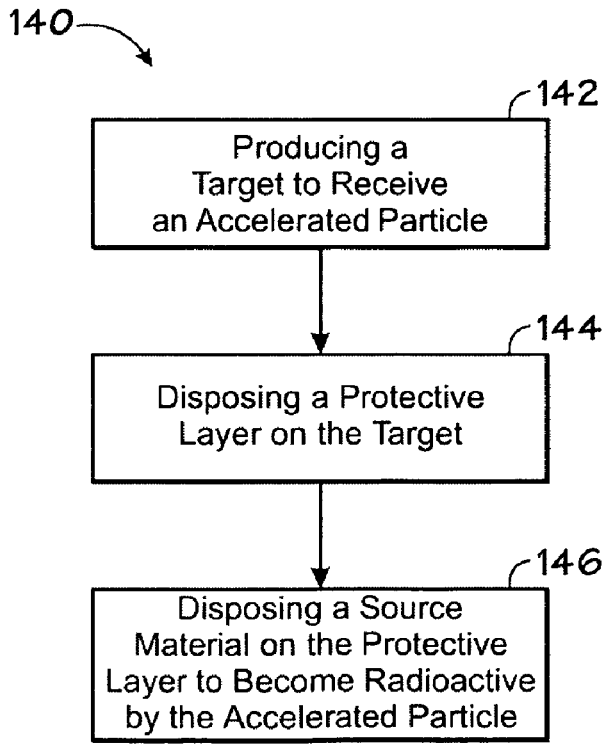
FIG. 7 is a flow chart of a method for preparing a target body.

FIG. 7 is a flow chart 140 illustrating a process for producing a target (e.g., 12) having a protective layer. The method begins at block 142 where a base material, such as the base material 18 shown in FIG. 1, is produced. The material of the base layer 18 may include a metallic substance, such as copper or aluminum or combinations thereof. Thereafter, the method proceeds to block 144 where a protective layer, such the chromium layer 16 shown in FIG. 1, may be disposed on the base layer 18. The protective layer 16 may be adapted to chemically shield the base material 18 from certain chemicals once the target body 12 is chemically processed and the layer 14 is removed from the target body 12.

The protective layer 16, such as the chromium layer, can be electroplated on the base layer 18 to a certain thickness and roughness. For example, the electroplating process may be significantly extended (e.g., 20-50 minutes rather than several minutes or less) to increase the thickness and create a rough or a matte-finished surface. Thereafter, the method proceeds to block 146 where a source or starting material layer, such as the thallium 203 layer 14 may be disposed on the protective layer 16.

Figure 8:
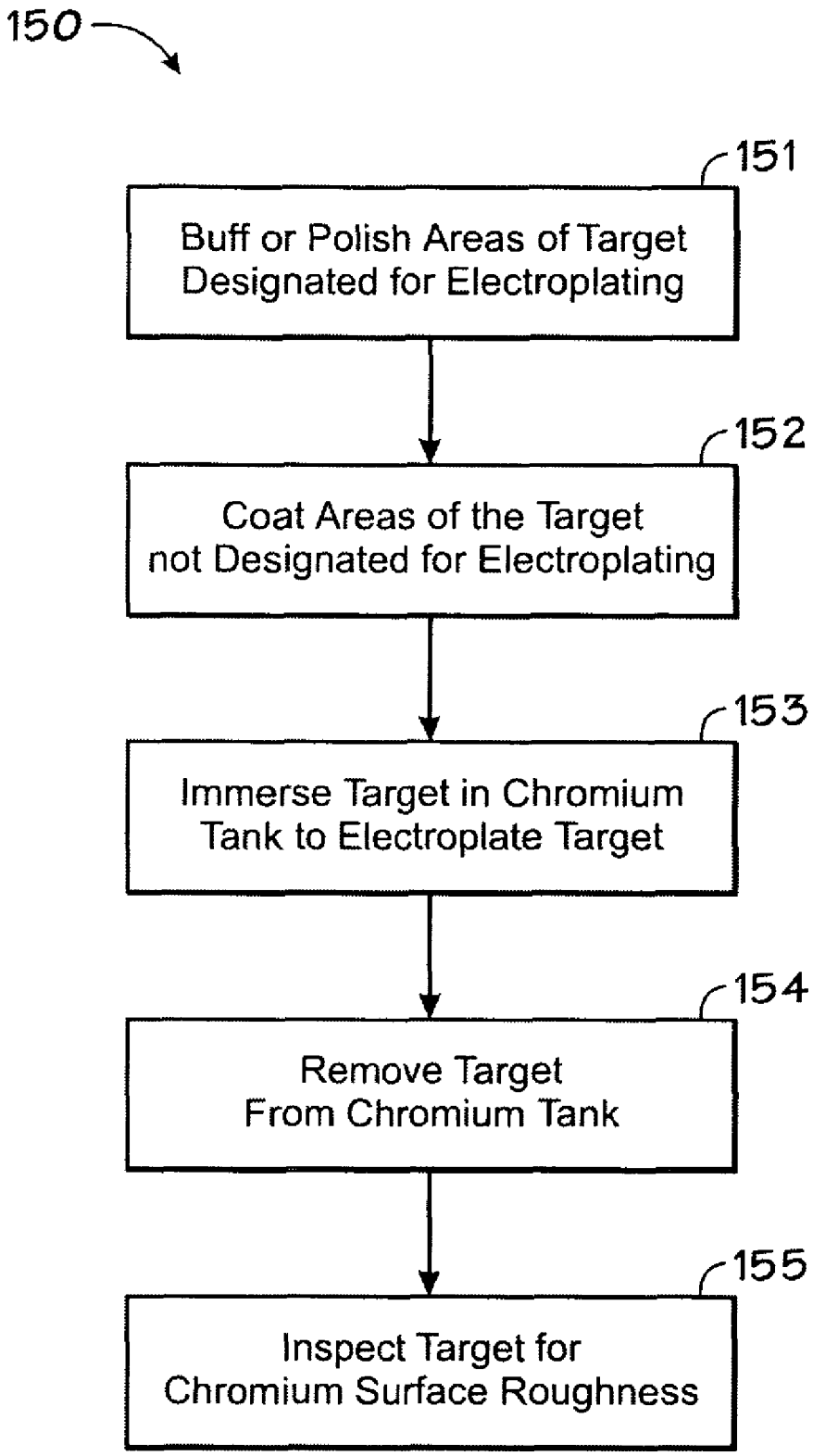
FIG. 8 is a flow chart of a method for electroplating of a target body.

FIG. 8 is a flow chart 150 illustrating an electroplating process. The process begins at block 151 whereby portions of the base layer 18 of the target body 12 designated for electroplating may be buffed or polished prior to being electroplated. Thereafter, in step 152, portions of the base layer 18 not designated for electroplating may be coated with a coating material adapted to prevent those areas or portions from being electroplated. Thereafter, the method proceeds to block 153 where the target body 12 may be immersed in a tank containing a chromium solution. The tank may be coupled to a power supply providing sufficient current to enable the electroplating process. The chromium solution in the tank may be kept at a temperature of approximately 125 degrees Fahrenheit as the target body 12 is electroplated for an amount of time ranging between 20-50 minutes. Next, the method proceeds to step 154 where the target body 12 may be removed from the tank. Thereafter, the method proceeds to step 155, whereby the surface of the newly formed electroplated chromium layer 16 may be inspected to verify that it has the desired texture and surface morphological characteristics. Such characteristics may adapt the surface of the chromium layer 16 to retain the layer 14.

Figure 9:
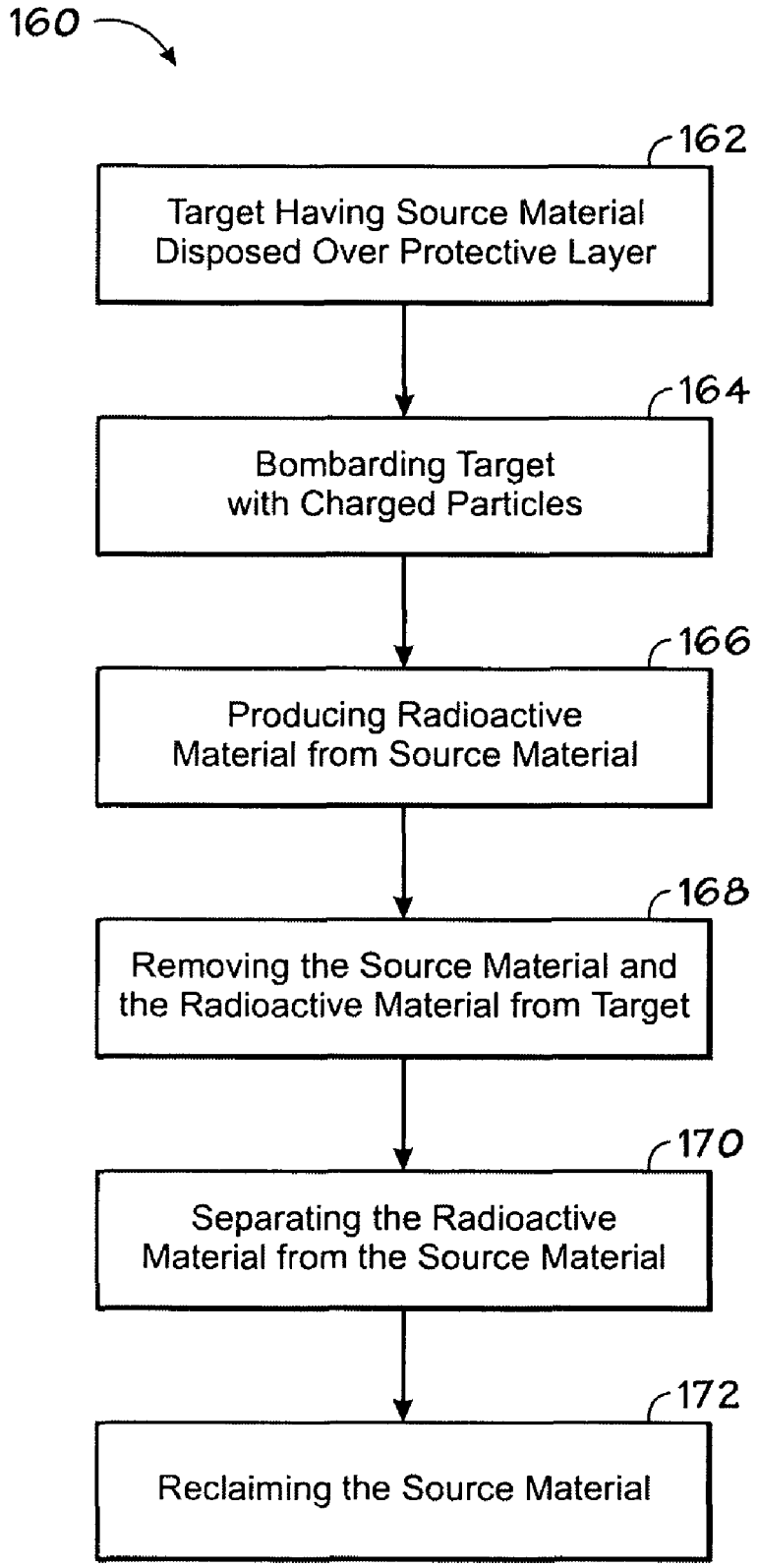
FIG. 9 is a flow chart of a method for producing radioisotopes.

FIG. 9 is a flow chart 160 of a process for producing radioisotopes from a radioisotope starting material. The process 160 provides a method for reclaiming the starting material 14 with relative ease in a short period of time (e.g., several hours or days rather than several months or years) after the irradiation of the target body 12 by energetic particles. The process begins at block 162 whereby a source or a starting material (e.g., thallium 203) may be disposed on the target body 12 over the protective layer 16. In other embodiments, the starting material may include other types of substances from which radiopharmaceuticals may be produced. Once the starting material 14 is disposed on the target body 12, the process may proceed to block 164 during which the target body 12 may be irradiated with charged particles. Thereafter, the process may proceed to block 166 whereby irradiation of the source layer 14 may initiate nuclear reactions transforming portions thereof into a radioisotope that may be used as a radiopharmaceutical. For example, bombardment of thallium 203 with energetic protons may yield radioisotope lead 201. Although lead 201 may not be the final product used as a radiopharmaceutical, its subsequent nuclear decay may produce a radiopharmaceutical, namely, thallium 201.

The method then may proceed to block 168 whereby the layer 14 containing the source material and the newly formed radioisotope material may be removed from the target body 12 (FIG. 1). For example, stripping-off lead 201 and thallium 203 disposed on the target body 12 after irradiation may be achieved by using a hot nitric acid solution. The hot nitric acid solution may dissolve the layer 14 without affecting the chromium protective layer 16. Thereafter, the process may proceed to block 170 where the radioisotope material and the starting material may be chemically separated. For example, the lead 201 may be separated from the starting thallium 203 by a variety of suitable chemical methods. After removing the lead 201 from the original solution, the thallium 203 is left behind. Accordingly, the method may proceed to block 172 where the starting material, such as the thallium 203, may be reclaimed for reuse. In this manner, the thallium 203 can be reclaimed and reused quite quickly (e.g., several hours or days) after the target body 12 is irradiated. Hence, the process 160 provides a significant improvement over previous methods, which would allow reclaiming the thallium 203 only after a substantial period of time, which may be as long as six months or greater.

Figure 10:
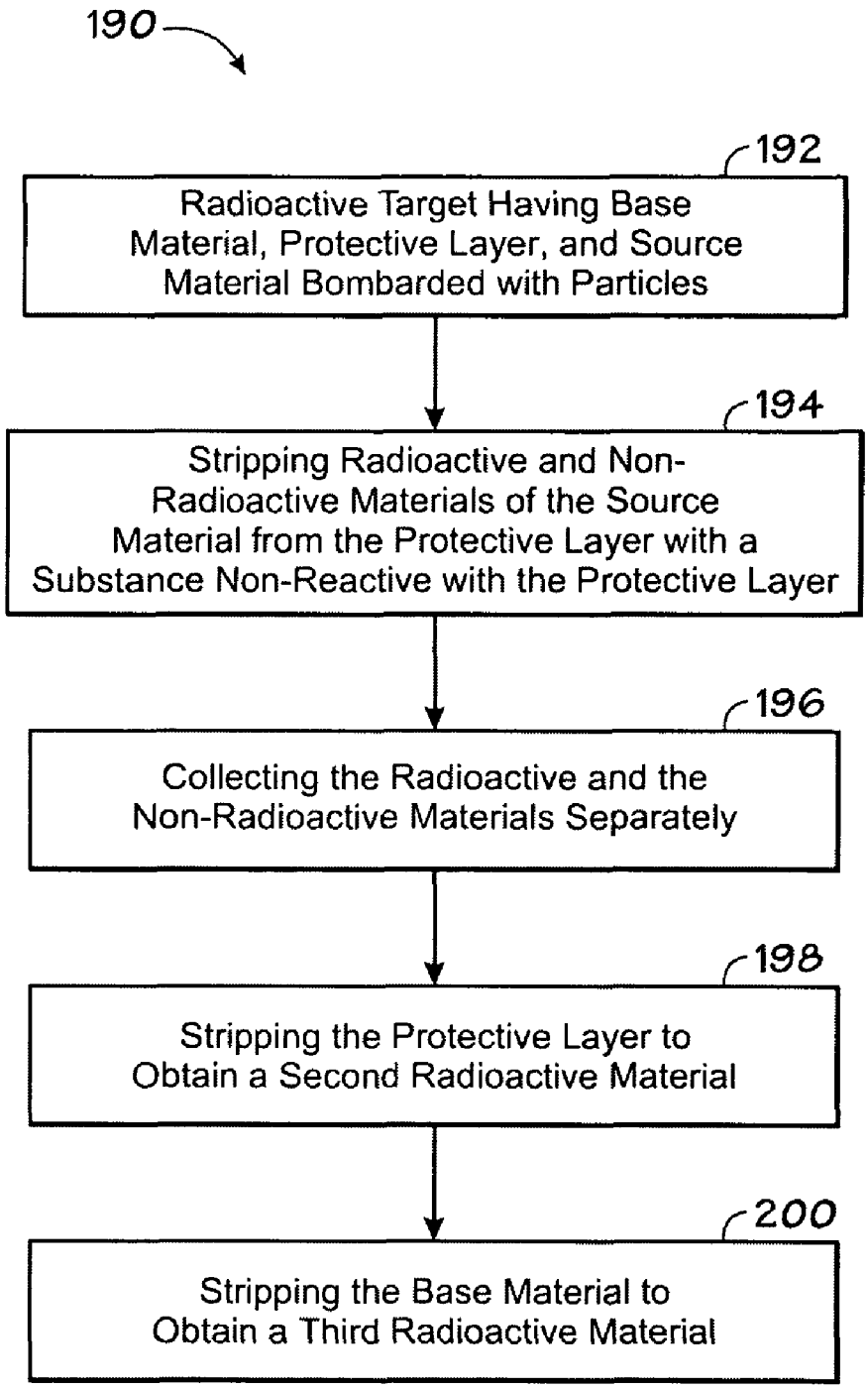
FIG. 10 is a flow chart of a method for collecting multiple radioactive materials from a target body.

FIG. 10 illustrates a flow chart 190 of a process for removing and separating radioisotopes from a target, such as the target body 12 of FIG. 1, after the target is bombarded with energetic charged particles. The method begins at block 192 when a layer 14 containing radioisotope starting material and radioisotope material are disposed on a target. A protective layer, such as the chromium protective layer 16, may be disposed underneath the starting material 14 and may also include radioisotopes resulting from the irradiation of the target body 12. Accordingly, the process may proceed to block 194 during which the radioisotope and the starting material may be removed from the target body 12 via chemical processing, such as the chemical processing mentioned above with reference to the process 160 of FIG. 9. Again, such chemical processing may be adapted to chemically react and, thus, remove only the radioisotope and the starting materials 14 disposed on the target body 12, while not reacting with the underlying protective chromium layer 16. The protective chromium layer 16 is adapted to shield the underlying base layer 18 of the target body 12 so that radioisotope materials produced from the base layer 18 may not dissolve or become part of a solution containing the desired radioisotope material and the starting material 14. By generally preventing radioisotope material originating from the base layer 18 of the target body 12 to mix with the desired radioisotope material, a more efficient and quick recovery of the source radioisotope material may be possible.

Hence, once the radioisotope and the starting material are both removed or stripped from the target body 12, the method may proceed to block 196 where the radioisotope material and the radioisotope starting materials are separated and collected for use. The method then proceeds to block 198 where the protective chromium layer 16, including radioisotopes produced therefrom, may be stripped-off the target 14. In this manner, a second radioisotope bi-product, which can also be used as a radiopharmaceutical, is obtained from the protective chromium layer 16. The removal of the protective chromium layer 16 from the target 14 may be achieved using specific chemicals designed to remove the chromium layer 16 while being chemically inert to the materials from which the base layer 18 of the target are made. This generally prevents radioisotopes having long half-lives contained within the base layer 18 of the target from dissolving in a solution containing radioisotopes derived from the protective chromium protective layer 16. In certain embodiments, chromium 51 may be produced in the chromium layer 16 as a byproduct when the target 14 is irradiated, and can be removed from the target 14 using hydrochloric acid which may not interact with metals contained in the base layer 18 of the target. Again, this enables claiming the chromium 51 radioisotope without having to wait for prolonged periods of time to allow radiation levels produced from long half-life radioisotopes within the base layer 18 to decay to an acceptable level.

Thereafter, the method may proceed to step 200 whereby the base material or portions thereof may be stripped-off to produce a third radioisotope, such as copper which may in turn subsequently decay into usable radiopharmaceuticals. Thus, the method 190 may enable the production of three radiopharmaceuticals from a target in a single irradiation. This significantly improves the cost-effectiveness of producing radioisotopes from which radiopharmaceuticals may be obtained.

Figure 11:
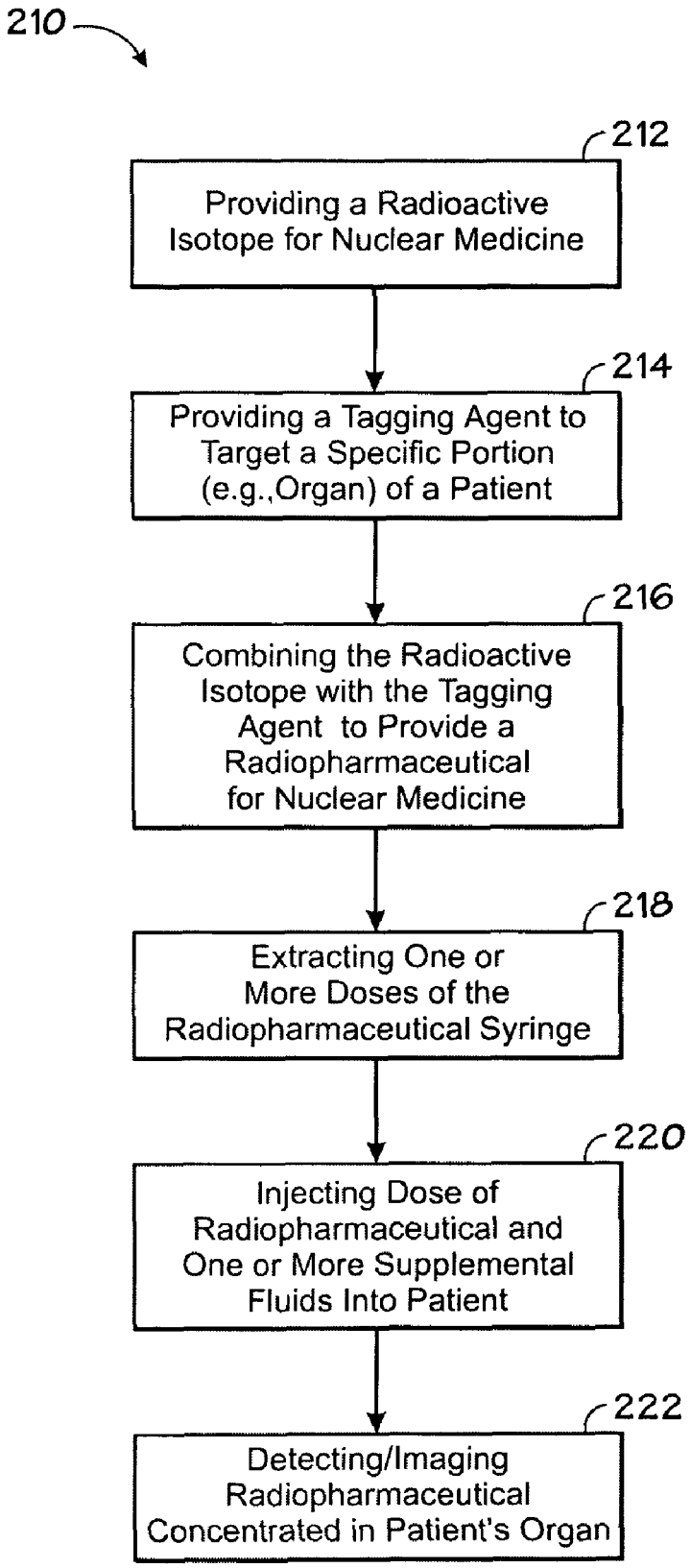
FIG. 11 is flow chart of a method for using medical imaging.

FIG. 11 is a flowchart 210 illustrating an exemplary nuclear medicine process utilizing one or more radiopharmaceuticals described herein and as illustrated with reference to FIGS. 1-10. As illustrated, the process 210 begins by providing a radioisotope isotope for nuclear medicine at block 212. For example, block 212 may include generating thallium 201 or another radioisotope from a target body 12 having the protective layer 16 as described above. At block 214, the process 210 proceeds by providing a tagging agent (e.g., an epitope or other appropriate biological directing moiety) adapted to target the radioisotope for a specific portion, e.g., an organ, of a patient. At block 216, the process 210 then proceeds by combining the radioisotope isotope with the tagging agent to provide a radiopharmaceutical for nuclear medicine. In certain embodiments, the radioisotope isotope may have natural tendencies to concentrate toward a particular organ or tissue and, thus, the radioisotope isotope may be characterized as a radiopharmaceutical without adding any supplemental tagging agent. At block 218, the process 210 then may proceed by extracting one or more doses of the radiopharmaceutical into a syringe or another container, such as a container suitable for administering the radiopharmaceutical to a patient in a nuclear medicine facility or hospital. At block 220, the process 210 proceeds by injecting or generally administering a dose of the radiopharmaceutical and one or more supplemental fluids into a patient. After a pre-selected time, the process 210 proceeds by detecting/imaging the radiopharmaceutical tagged to the patient's organ or tissue (block 222). For example, block 222 may include using a gamma camera or other radiographic imaging device to detect the radiopharmaceutical disposed on or in or bound to tissue of a brain, a heart, a liver, a tumor, a cancerous tissue, or various other organs or diseased tissue.

Figure 12:
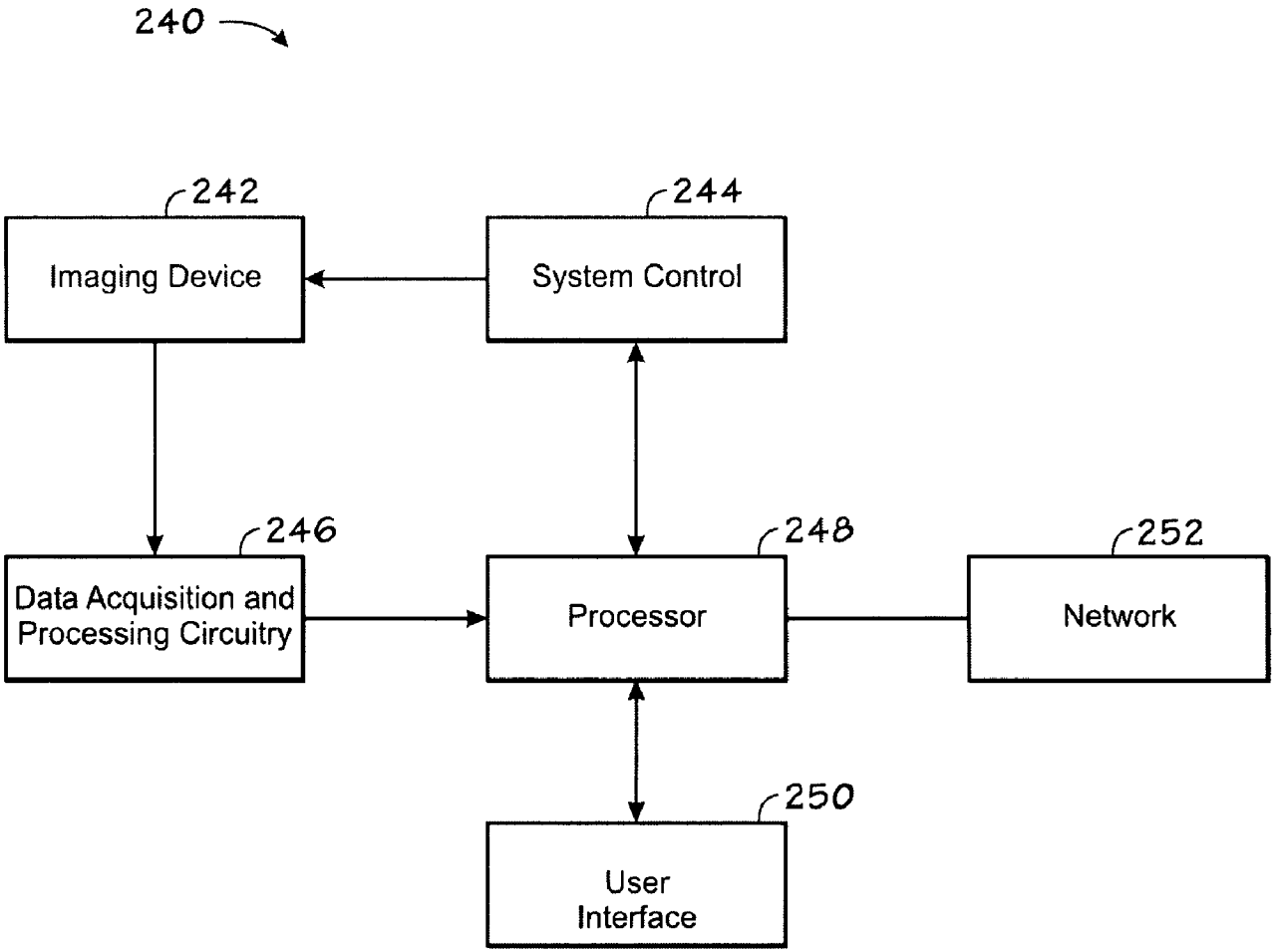
FIG. 12 is a block diagram of an imaging system.

Referring to FIG. 12, an imaging system 240 that may use the radiopharmaceuticals acquired by the techniques of FIGS. 1-11 may include an imaging device 242, a system control 244, data acquisition and processing circuitry 246, a processor 248, a user interface 250, and a network 252. Specifically, the imaging device 242 is configured to obtain signals representative of an image a subject after a radiopharmaceutical has been administered to the subject. The imaging system 240 may include a positron emission tomography (PET) system, a single photon emission computer tomography system, a nuclear medicine gamma ray camera, or another suitable imaging modality. Image data indicative of regions of interest in a subject may be created by the imaging device 242 either in a conventional support, such as photographic film, or in a digital medium.

The system control 244 may include a wide range of circuits, such as radiation source control circuits, timing circuits, circuits for coordinating data acquisition in conjunction with patient or table of movements, circuits for controlling the position of radiation detectors, and so forth. The imaging device 242, following acquisition of the image data or signals, may process the signals, such as for conversion to digital values, and forward the image data to data acquisition circuitry 246. In the case of analog media, such as photographic film, the data acquisition system may generally include supports for the film, as well as equipment for developing the film and producing hard copies that may be subsequently digitized. For digital systems, the data acquisition circuitry 246 may perform a wide range of initial processing functions, such as adjustment of digital dynamic ranges, smoothing or sharpening of data, as well as compiling of data streams and files, where desired. The data is then transferred to a processor 248 where additional processing and analysis is performed. For conventional media such as photographic film, the processor 248 may apply textual information to films, as well as attach certain notes or patient-identifying information. In a digital imaging system, the data processing circuitry performs substantial analyses of data, ordering of data, sharpening, smoothing, feature recognition, and so forth.

Ultimately, the image data is forwarded to an operator/user interface 250 for viewing and analysis. While operations may be performed on the image data prior to viewing, the operator interface 250 is at some point useful for viewing reconstructed images based upon the image data collected. In the case of photographic film, images may be posted on light boxes or similar displays to permit radiologists and attending physicians to more easily read and annotate image sequences. The image data can also be transferred to remote locations, such as via a network 252. In addition, the operator interface 250 may enable control of the imaging system, e.g., by interfacing with the system control 244.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed:

1. A target body for use in the production of radioisotopes, the target body comprising:

a base comprising a thermally conductive material, and a coolant path;

a protective layer disposed on the base, the protective layer comprising chromium; and a radioisotope starting material disposed on the base, the radioisotope starting material comprising thallium 203, wherein the protective layer is disposed between the base and the radioisotope starting material, wherein the protective layer is chemically resistant to removal by nitric acid, and the radioisotope starting material and the thermally conductive material of the base are susceptible to removal by nitric acid.

2. The target body of claim 1, wherein the protective layer is electroplated on the base.

3. The target body of claim 2, wherein the protective layer comprises a surface having a matte finish.

4. The target body of claim 1, wherein the protective layer further comprises one or more of iridium, tantalum, tungsten, gold, niobium, aluminum, zirconium, or platinum, and combinations thereof.

5. The target body of claim 1, wherein the base comprises one or more of copper, aluminum and combinations thereof.

6. A target body for use in the production of radioisotopes, the target body comprising:

a base comprising a coolant path, wherein the coolant path is a groove formed in the base;

a protective layer disposed on the base, the protective layer comprising an electroplated layer including chromium; and a radioisotope starting material disposed on the base, wherein the protective layer is disposed between the base and the radioisotope starting material.

7. A target body for use in the production of radioisotopes, the target body comprising:

a base comprising a coolant path;

a protective layer disposed on the base, the protective layer comprising an electroplated layer including chromium; and a radioisotope starting material disposed on the base, wherein the protective layer is disposed between the base and the radioisotope starting material, wherein the base comprises aluminum and is coated with copper.

8. A target body for use in the production of radioisotopes, the target body comprising:

a base comprising a coolant path;

a protective layer disposed on the base, the protective layer comprising an electroplated layer including chromium; and a radioisotope starting material disposed on the base, wherein the protective layer is disposed between the base and the radioisotope starting material, wherein the radioisotope starting material comprises thallium 203.

9. A target body for use in the production of radioisotopes, the target body comprising:

a base comprising a thermally conductive material, and a coolant path, wherein the thermally conductive material is susceptible to chemical stripping using nitric acid;

a protective layer disposed directly on the base, wherein the protective layer is resistant to chemical stripping using nitric acid; and a radioisotope starting material disposed directly on the protective layer such that the protective layer is disposed between the base and the radioisotope starting material, the radioisotope starting material being capable of forming radiopharmaceutical thallium 201 after being irradiated, and being susceptible to chemical stripping using nitric acid, wherein the protective layer is configured to inhibit the removal of the thermally conductive material during chemical stripping of the radioisotope material using nitric acid.

10. The target body of claim 9, wherein the base comprises copper.

11. The target body of claim 10, wherein the protective layer comprises chromium.

12. The target body of claim 11, wherein the radioisotope starting material comprises thallium 203.

* * * * *